US007774085B2

(12) United States Patent
Yang

(10) Patent No.: US 7,774,085 B2
(45) Date of Patent: Aug. 10, 2010

(54) INERTIA COMPENSATING DANCER ROLL FOR WEB FEED

(75) Inventor: Ming Yang, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 587 days.

(21) Appl. No.: 11/750,370

(22) Filed: May 18, 2007

(65) Prior Publication Data

US 2008/0283567 A1 Nov. 20, 2008

(51) Int. Cl.
*G06F 19/00* (2006.01)

(52) U.S. Cl. ..... 700/126; 700/97; 700/98; 700/122

(58) Field of Classification Search ..... 700/97, 700/98, 122, 126; 242/410; 226/1, 118, 226/195

See application file for complete search history.

(56) References Cited

U.S. PATENT DOCUMENTS 3,659,767 A 5/1972 Martin
4,218,026 A 8/1980 Stange
6,032,004 A 2/2000 Mirabella, Jr. et al.
6,473,669 B2 * 10/2002 Rajala et al. ..... 700/122
7,130,571 B2 10/2006 Berg et al.
7,191,973 B2 3/2007 Gretsch et al.

OTHER PUBLICATIONS

Reid, K.N. And Lin, Ku-Chin, Dynamic Behavior of Dancer Subsystems in Web Transport Systems, Proceedings of the Second International Conference on Web Handling, p. 135-146, Jun. 6-9, 1993).

* cited by examiner

*Primary Examiner*—Albert DeCady
*Assistant Examiner*—Steven R Garland
(74) *Attorney, Agent, or Firm*—Gibb I.P. Law Firm, LLC

(57) ABSTRACT

A printing apparatus, method, and computer program of designing a floating roller in a tensioning system adapted to one of supply and receive a web of material to or from one of a web supply and a processing machine, comprising inputting external radius of said floating roller, measure of elasticity of the material, a thickness of the material, width of the material, and angles at which the material contacts the floating roller; and adjusting mass of the floating roller and rotational inertia of the floating roller based on external radius of the floating roller, measure of elasticity of the material, thickness of the material, width of the material, and angles at which the material contacts the floating roller such that the floating roller maintains a constant tension on the web of material as the material is passing through the tensioning system.

19 Claims, 3 Drawing Sheets

INERTIA COMPENSATING DANCER ROLL FOR WEB FEED

BACKGROUND AND SUMMARY

Embodiments herein generally relate to rollers used to supply continuous webs of printing sheets (rolls of paper) to/from printing devices and more particularly to inertia compensated dancer roll design.

U.S. Pat. No. 3,659,767 to J. R. Martin (hereinafter referred to as "Martin" and fully incorporated herein by reference) discloses a "dancer" roll used in a system for supplying a continuous printing sheet to/from printing devices. The dancer roll is a roller over which the paper (or other printing medium) passes as it is being transported from a roll (medium source) to a printing device or from a printing device to a finishing device. The dancer roll provides a constant tension on the printing medium to attenuate and insulate motion disturbances form reaching the motion crucial areas of the printer.

More specifically, Martin describes that a recurring problem in systems for performing operations on webs of paper, cloth or other suitable material is the regulation of web tension. Such problems may arise in a number of arts such as printing, film and plastic processing, and magnetic tape recording. In the operation of high speed continuous printing presses the problems of regulating web tension are particularly important. Failure to prevent tension changes in a moving paper web results in stretching and shrinking of the web along its length. When this occurs in the region in which the web is being printed it leads to defects in the printed product such as slurring, doubling and ghosting of images, color mis-registration, and if the tension becomes too great, breaking of the web and interruption of operations.

There are several causes of tension fluctuation in printing press operation. These include variations in the web's modulus of elasticity due to material irregularities or changes in temperature or humidity, rolls which have flat spots or are elliptical in cross section, drifting in the speed of the various drive rolls and the supply roll, irregularities in the operation of braking mechanisms, and the operation of flying pasters which join one supply roll to another while the press is in operation.

A number of means have been developed to regulate or control tension, none of which completely solve the problem of preventing transient changes or fluctuations in tension in one region of the web from causing tension changes in other regions. One approach has been to utilize one or more dancer rolls—floating rotating cylinders each of which, when placed between two idler rolls and offset therefrom, constrains the web into a loop and exerts force on the bight of the loop. This force, which may be a result of the weight of the dancer or of a force exerted on the dancer by a spring, a fluid pressure actuated cylinder, or an external weight, or some combination thereof, establishes an average level of tension in the loop. It does not, however, completely compensate for changes in web tension on one side of the dancer which usually cause tension changes on the other side of the dancer.

Martin explains that devices have been developed in which the position of a roller, which changes as the web tension changes, is sensed to produce an input signal for a control circuit. The control circuit may be used to adjust another parameter which can affect web tension such as the speed of the supply roll or of drive rolls thus readjusting the web tension to compensate for the initial change and restoring the dancer to its initial position.

In order to address the foregoing issues, embodiments herein comprise a printing apparatus (e.g., an electrostatographic and a xerographic machine, etc.); an associated method of making a floating roller; and an associated computer program. The apparatus includes a tensioning system having a plurality of rollers. One of the rollers (e.g., a receiver roller) is adapted to receive a web of material from a web supply or a processing machine, and another roller (e.g., an output roller) is adapted to output the web of material to a processing machine or a finishing device. A floating roller is positioned between the receiver roller and the output roller and is adapted to pass the material from the receiver roller to the output roller. The floating roller is mounted to rotate and travel along at least one linear path or pivot around some center to move the floating roller center. The apparatus can further comprise rotating rollers in fixed positions adjacent the floating roller, such that the floating roller moves relative to the rotating rollers to maintain the constant tension on the web of material.

The relationship between mass of the floating roller and rotational inertia of the floating roller controls the tensioning system to maintain a constant tension on the web of material. More specifically, the relationship between mass of the floating roller and rotational inertia of the floating is based on the following equation:

$$M_2 \approx \left(1 - \frac{T_{a3}}{Ebw}\right)\sin^2(\alpha/2)\frac{J_2}{R_2^2}$$

wherein $M_2$ is a mass of the floating roller, $J_2$ is a rotational inertia of the floating roller, $R_2$ is an external radius of the floating roller, E is a Young's modulus of the web of material, b is a thickness of the web of material, w is a width of the web of material, $T_{a3}$ is a tension force on the material and $\alpha$ (wrap angle) is an angle at which the web of material contacts the floating roller.

Similarly, a method embodiment of designing a floating roller in a tensioning system adapted to supply a web of material from a web supply to a processing machine comprises inputting an external radius of the floating roller, a measure of elasticity of the material, a thickness of the material, a width of the material, and angles at which the material contacts the floating roller; and adjusting a mass of the floating roller and a rotational inertia of the floating roller such that the floating roller maintains a constant tension on the web of material as the material is passing through the tensioning system based on the following equation:

$$M_2 \approx \left(1 - \frac{T_{a3}}{Ebw}\right)\sin^2(\alpha/2)\frac{J_2}{R_2^2}$$

wherein $M_2$ is the mass of the floating roller, $J_2$ is the rotational inertia of the floating roller, $R_2$ is the external radius of the floating roller, E is a Young's modulus of the web of material, b is the thickness of the web of material, w is the width of the web of material, $T_{a3}$ is the tension force on the material and $\alpha$ (wrap angle) is an angle at which the web of material contacts the floating roller.

These and other features are described in, or are apparent from, the following detailed description.

BRIEF DESCRIPTION OF THE DRAWINGS

Various exemplary embodiments of the systems and methods are described in detail below, with reference to the attached drawing figures, in which.

DETAILED DESCRIPTION

Figure 1:
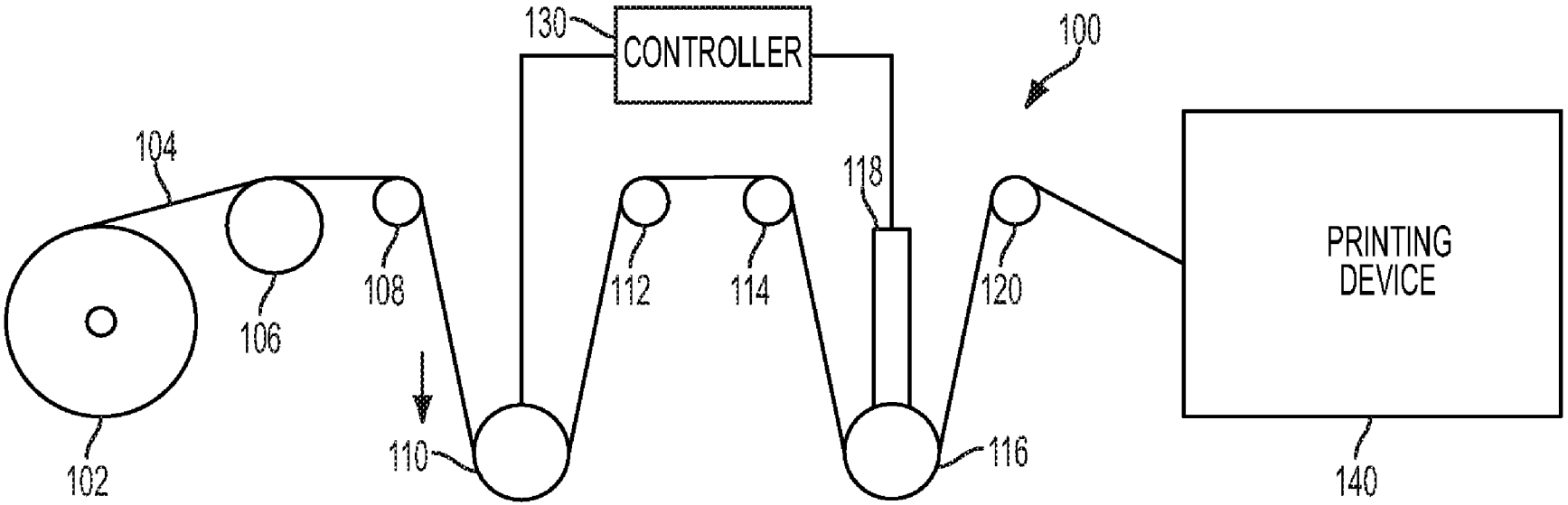
FIG. 1 is a schematic representation of a tensioning apparatus according to embodiments herein.

While the present method and structure will be described in connection with embodiments thereof, it will be understood that this disclosure is not limited to the disclosed embodiments. On the contrary, this disclosure is intended to cover all alternatives, modifications, and equivalents as may be included within the spirit and scope, as defined by the appended claims.

In systems that perform web feeding of continuous sheets of material from rolls, a good dancer design is useful to ensure high motion quality. The dancer system is widely used in web handling to attenuate and insulate disturbance from reaching the motion quality sensitive area such as printing station. Martin's system discussed above provides an inertia-compensated roller that is able to damp disturbance of all frequencies when the web stretch is negligible and when the wrap angle $\alpha$ is 180 degree (see Reid, K. N. and Lin, Ku-Chin, Dynamic Behavior of Dancer Subsystems in Web Transport Systems, Proceedings of the Second International Conference on Web Handling, p 135-146, Jun. 6-9, 1993).

If web stretch is presented, the inertia compensated dancer system still shows remaining disturbance, the remaining disturbance may be as big as, or even bigger than, the input disturbance. Furthermore, the inertia compensated dancer roll design needs to be modified when the web wrap angle on the dancer is not 180 degrees to achieve good dancing effects.

This disclosure enhances such systems as the one presented in Martin by providing an inertia compensated dancer roll design that takes into consideration of web stretch so that motion disturbance of all frequencies may be still damped and insulated from reaching any critical areas, even when the web (paper) is stretchable.

The inertia compensated dancer roll design shown in Martin in 1972 was based on an analysis which assumed 1) there was no web stretch; and 2) the web wrap angle at the dancer roll is 180 degrees. Therefore, assume the mass of the dancer roll is M2 and the rotational inertia of the dancer roll is J2 and the external radius of the roll is R2, then Martin's inertia-compensated roll is designed based on the following equation:

$$M_2 = \frac{J_2}{R_2^2} \tag{1}$$

In practice, this usually required some kind of flywheel attached to the dancer. To address the web stretch issue, this disclosure presents a dynamic model that includes the web stretch effects (assuming that the stretch still follows the linear stress and strain relation). More specifically, the dynamic model yields the following equation:

$$M_2 \approx \left(1 - \frac{T_{a3}}{Ebw}\right)\sin^2(\alpha/2)\frac{J_2}{R_2^2} \tag{2}$$

wherein $M_2$ is the mass of the floating roller, $J_2$ is the rotational inertia of the floating roller, $R_2$ is the external radius of the floating roller, E is a Young's modulus of the web of material, b is a thickness of the web of material, w is a width of the web of material, $T_{a3}$ is the web tension force and $\alpha$ (wrap angle) is an angle at which the web of material contacts the floating roller. More specifically, $T_{a3}$ is the desired/designed constant tension, which is a design parameter that should be known before any measurement is taken and it should not change in operation. If $T_{a3}$ needs to be changed, another roll should be designed and manufactured according to the foregoing equation. The equation is therefore used to design the inertia compensating roll (dancer), i.e. to specify the relation between mass and the rotational inertia of the floating roller. With such design specifications, the size (radius, length, thickness, etc.) of the floating roller is adjusted such that the relationship between the mass and the rotational inertial of the floating roller complies with the foregoing equation.

Note the inertia-compensated roll theoretically leaves no disturbance when the "≈" sign is replaced by a true "=" sign. Comparing equation (2) with the Martin design rule of equation (1), we can see the Martin equation is valid only when the web stretch is negligible and the web wrap angle at the dancer roll is exactly 180 degrees. Thus, the embodiments herein completely compensate for all situations even in places where the web is stretchable and where the wrap angle is different from 180 degrees.

As shown in FIG. 1, a printing apparatus (e.g., an electrostatographic and a xerographic machine, etc.) embodiment includes a tensioning system 100 having a plurality of rollers and a controller 130 operatively connected to at least one of the rollers. One of the rollers (e.g., a receiver roller 106) is adapted to receive a web of material 104 from a web supply (such as a roll of paper) 102 or processing machine such as a printing device. The web of material 104 is supported by and contacts a series of fixed rollers 108, 112, 114, before reaching a last roller (e.g., an output roller 120) that is adapted to output the web of material 104 to a processing machine 140, such as a printing device or a finishing device. One ordinarily skilled in the art would understand that the tensioning system 100 could include more rollers or less rollers, there may have more than one tension roller (dancer roller) to insulate either disturbance from difference sources or disturbance from the same source, and FIG. 1 is only one example of many different variations of the embodiments herein. Further, the embodiments can include many other features, such as those disclosed in U.S. Pat. No. 4,218,026 (incorporated herein by reference).

The controller 130 is adapted to control the tensioning system to maintain a constant tension on the web of material 104. More specifically, the controller 130 controls the tension of the web of material 104 by observing measured forces on the dancer roller 110 (e.g., floating roller 110) and applying compensating force to a compensation roller 116. As described in Martin, unlike idle rollers 106, 108, 112, 114, and 120 that are fixed in place and cannot move vertically or horizontally (but can rotate or roll); the dancer roller 110 and the compensation roller 116 can not only roll, but can also move (e.g., horizontally, vertically, or any combination of horizontally and vertically).

Further, the dancer roller 110 is biased (by a biasing member, such as a spring, weights, etc.) in a direction that will maintain tension on the web of material 104. In other words, the dancer roller 110 is biased to move away from the adjacent fixed idle rollers 108, 112, so as to apply tension on the web of material 104. The amount that the dancer roller 110 is forced back in a direction opposite to the biasing direction by the pull of the web of material 104 is measured by a measuring device attached to the structure supporting the dancer roller 110 and this measure of force is supplied to the controller 130. See Martin and U.S. Pat. No. 7,191,973 (incorporated herein by reference) for complete details of biasing and measurement devices. Further, as would be understood by those ordinarily skilled in the art, any form of measurement apparatus could be used herein.

Some form of force generator 118 is connected to the compensation roller 116 and to the controller 130. Again, see Martin and U.S. Pat. No. 7,130,571 (incorporated herein by reference) for complete details of such devices. Further, as would be understood by those ordinarily skilled in the art, any form of movement apparatus could be used herein to move the compensation roller toward or away from the fixed rollers 114, 120 so as to add or remove tension from the web of material 104.

Figure 3:
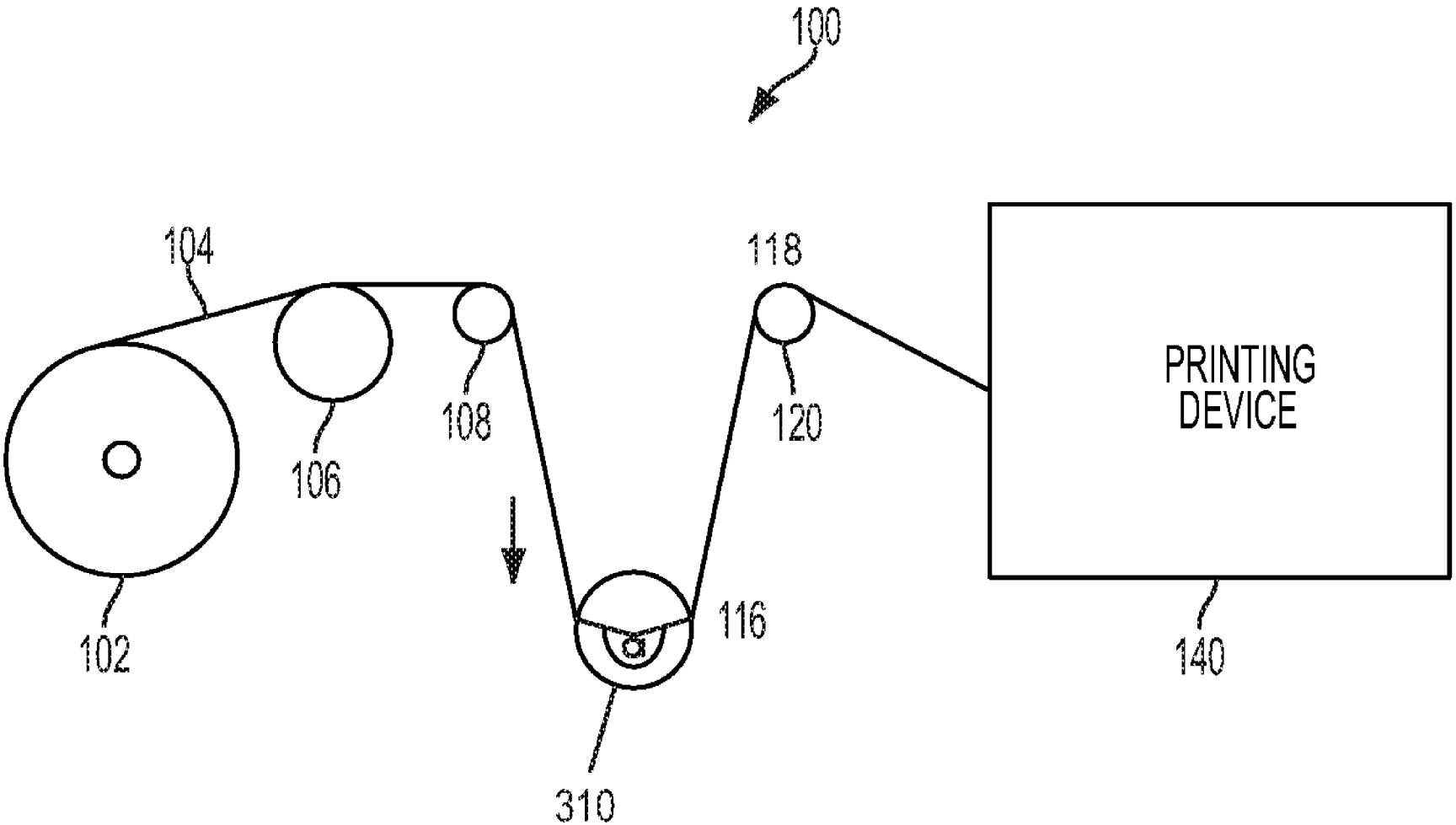
FIG. 3 is a schematic representation of a tensioning apparatus according to embodiments herein.

Moreover, a dancer roller (floating roller) 310 designed according to equation (2) may used in a system shown in FIG. 1 or FIG. 3 which may or may not have a controller.

The relationship between mass and rotational inertia of the floating roller 310 is based on various measures including the external radius of the floating roller 310, a measure of elasticity of the web of material 104, and an angle ($\alpha$) at which the web of material 104 contacts the floating roller 310. The angle ($\alpha$) is measured as the radial distance between lines extending from the axis of the floating roller 310 to the points where the web of material 104 first makes contact with the floating roller and where the web of material last makes contact with the floating roller. In other words, if the floating roller 310 circumference covers 360°, the angle ($\alpha$) is the portion (measured in degrees) of that 360° circumference where the web of material 104 contacts the floating roller 310. Other items the design equation (2) is based on include the thickness of the web of material 104, and the width of the web of material 104.

In one embodiment, the design of the floating roller requires the mass of the floating roller and the rotational inertia to be based on the following equation:

$$M_2 \approx \left(1 - \frac{T_{a3}}{Ebw}\right)\sin^2(\alpha/2)\frac{J_2}{R_2^2} \tag{2}$$

wherein $M_2$ is the mass of the floating roller 310, $J_2$ is the rotational inertia of the floating roller 310, $R_2$ is the external radius of the floating roller 310, E is a Young's modulus of the web of material 104, b is a thickness of the web of material 104, w is a width of the web of material 104, $T_{a3}$ is the tension force on said material and $\alpha$ is an angle at which the web of material 104 contacts the floating roller 310.

Figure 2:
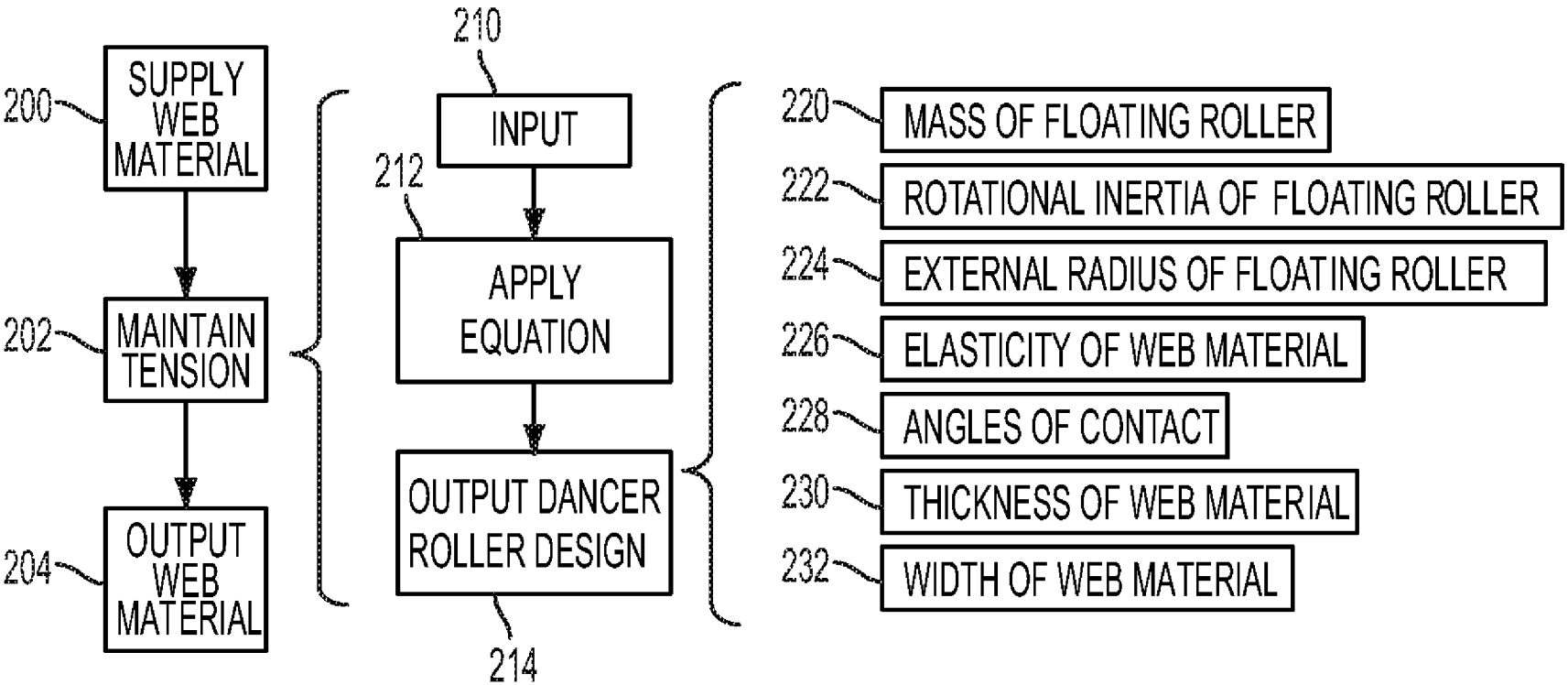
FIG. 2 is a flow diagram illustrating embodiments herein.

This is also shown in FIG. 2, where a web of material is supplied from a web supply to a tensioning system (item 200), the tensioning system maintains a constant tension on the web of material (item 202), and the tensioning system outputs the web of material from the tensioning system to a processing machine (item 204). The controlling of the tensioning system is based on the design of the floating roller 310. Thus, the design method comprises inputting the various measures described above (item 210), applying the equation (2) discussed above to cause the relationship between mass and rotational inertia of the dancer roller to maintain consistent tension on the web of material (item 212), and outputting the new dancer roller design (item 214).

In a similar manner to the apparatus embodiments, in the method embodiment of designing the dancer roller, the various measures include the mass of the floating roller (item 220), the rotational inertia of the floating roller (item 222), the external radius of the floating roller (item 224), a measure of elasticity of the web of material (item 226), and angles at which the web of material contacts the floating roller (item 228). Other items the design equation is based on include the thickness of the web of material (item 230), and the width of the web of material (item 232).

The word "printer" or "image output terminal" as used herein encompasses any apparatus, such as a digital copier, bookmaking machine, facsimile machine, multi-function machine, etc. which performs a print outputting function for any purpose. The details of printers, printing engines, etc. are well-known by those ordinarily skilled in the art and are discussed in, for example, U.S. Pat. No. 6,032,004, the complete disclosure of which is fully incorporated herein by reference. The embodiments herein can encompass embodiments that print in color, monochrome, or handle color or monochrome image data. All foregoing embodiments are specifically applicable to electrostatographic and/or xerographic machines and/or processes.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A method of designing a floating roller in a tensioning system adapted to one of supply and receive a web of material to or from one of a web supply and a processing machine, said method comprising:

inputting an external radius of said floating roller, a measure of elasticity of said material, a thickness of said material, a width of said material, and angles at which said material contacts said floating roller; and adjusting a mass of said floating roller and a rotational inertia of said floating roller based on said external radius of said floating roller, said measure of elasticity of said material, said thickness of said material, said width of said material, and said angles at which said material contacts said floating roller such that said floating roller maintains a constant tension on said web of material as said material is passing through said tensioning system.

2. The method according to claim 1, wherein said floating roller is adapted to rotate and travel along at least one approximately linear path.

3. The method according to claim 1, wherein said tensioning system comprises rotating rollers in fixed positions adjacent said floating roller, wherein said floating roller moves relative to said rotating rollers to maintain said constant tension on said web of material.

4. The method according to claim 1, wherein said processing machine comprises a printing device.

5. A method of designing a floating roller in a tensioning system adapted to one of supply and receive a web of material to or from one of a web supply and a processing machine, said method comprising:

inputting an external radius of said floating roller, a measure of elasticity of said material, a thickness of said material, a width of said material, and angles at which said material contacts said floating roller; and adjusting a mass of said floating roller and a rotational inertia of said floating roller such that said floating roller maintains a constant tension on said web of material as said material is passing through said tensioning system based on the following equation:

$$M_2 \approx \left(1 - \frac{T_{a3}}{Ebw}\right)\sin^2(\alpha/2)\frac{J_2}{R_2^2}$$

wherein $M_2$ is said mass of said floating roller, $J_2$ is said rotational inertia of said floating roller, $R_2$ is said external radius of said floating roller, E is a Young's modulus of said web of material, b is said thickness of said web of material, w is said width of said web of material, $T_{a3}$ is said tension force on said material and $\alpha$ is an angle at which said web of material contacts said floating roller.

6. The method according to claim 5, wherein said floating roller is adapted to rotate and travel along at least one approximately linear path.

7. The method according to claim 5, wherein said tensioning system comprises rotating rollers in fixed positions adjacent said floating roller, wherein said floating roller moves relative to said rotating rollers to maintain said constant tension on said web of material.

8. The method according to claim 5, wherein said processing machine comprises a printing device.

9. The method according to claim 5, wherein said material passes over and contacts said floating roller.

10. An apparatus comprising:

a receiver roller adapted to one of supply and receive a web of material to or from a web supply;

an output roller adapted to output said web of material to a processing machine; and a floating roller between said receiver roller and said output roller adapted to pass said material from said receiver roller to said output roller, a controller adjusting a mass of said floating roller and a rotational inertia of said floating roller based on an external radius of said floating roller, a measure of elasticity of said material, thickness of said material, width of said material, and an angle at which said material contacts said floating roller such that said floating roller maintains a constant tension on said web of material as said material is passing.

11. The apparatus according to claim 10, wherein said adjusting is based on the following equation:

$$M_2 \approx \left(1 - \frac{T_{a3}}{Ebw}\right)\sin^2(\alpha/2)\frac{J_2}{R_2^2}$$

wherein $M_2$ is said mass of said floating roller, $J_2$ is said rotational inertia of said floating roller, $R_2$ is said external radius of said floating roller, E is a Young's modulus of said web of material, b is said thickness of said web of material, w is said width of said web of material, $T_{a3}$ is said tension force on said material and $\alpha$ is an angle at which said web of material contacts said floating roller.

12. The apparatus according to claim 10, wherein said floating roller is mounted to rotate and travel along at least one approximately linear path.

13. The apparatus according to claim 10, further comprising rotating rollers in fixed positions adjacent said floating roller, wherein said floating roller moves relative to said rotating rollers to maintain said constant tension on said web of material.

14. The apparatus according to claim 10, wherein said processing machine comprises a printing device.

15. An apparatus comprising:

a receiver roller adapted to receive a web of material from a web supply;

an output roller adapted to output said web of material to a processing machine; and a floating roller between said receiver roller and said output roller adapted to pass said material from said receiver roller to said output roller, a controller that adjusts a mass of said floating roller and a rotational inertia of said floating roller such that said floating roller maintains a constant tension on said web of material as said material is passing based on the following equation:

$$M_2 \approx \left(1 - \frac{T_{a3}}{Ebw}\right)\sin^2(\alpha/2)\frac{J_2}{R_2^2}$$

wherein $M_2$ is said mass of said floating roller, $J_2$ is said rotational inertia of said floating roller, $R_2$ is an external radius of said floating roller, E is a Young's modulus of said web of material, b is a thickness of said web of material, w is a width of said web of material, $T_{a3}$ is said tension force on said material and $\alpha$ is an angle at which said web of material contacts said floating roller.

16. The apparatus according to claim 15, wherein said floating roller is mounted to rotate and travel along at least one linear path.

17. The apparatus according to claim 15, further comprising rotating rollers in fixed positions adjacent said floating roller, wherein said floating roller moves relative to said rotating rollers to maintain said constant tension on said web of material.

18. The apparatus according to claim 15, wherein said processing machine comprises a printing device.

19. A computer program product comprising:

a computer-usable data carrier storing instructions that, when executed by a computer, cause said computer to perform a method of designing a floating roller in a tensioning system adapted to one of supply and receive a web of material to or from one of a web supply and a processing machine, said method comprising:

inputting an external radius of said floating roller, a measure of elasticity of said material, a thickness of said material, a width of said material, and angles at which said material contacts said floating roller; and adjusting a mass of said floating roller and a rotational inertia of said floating roller based on said external radius of said floating roller, said measure of elasticity of said material, said thickness of said material, said width of said material, and said angles at which said material contacts said floating roller such that said floating roller maintains a constant tension on said web of material as said material is passing through said tensioning system.

* * * * *